US007573426B2

(12) United States Patent
Amano et al.

(10) Patent No.: US 7,573,426 B2
(45) Date of Patent: Aug. 11, 2009

(54) ANTENNA AND RADIO TERMINAL HAVING ANTENNA THEREOF

(75) Inventors: Takashi Amano, Soka (JP); Akihiro Tsujimura, Ome (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 46 days.

(21) Appl. No.: 11/606,872

(22) Filed: Nov. 30, 2006

(65) Prior Publication Data

US 2008/0129608 A1 Jun. 5, 2008

(51) Int. Cl.
*H01Q 1/24* (2006.01)

(52) U.S. Cl. ..... 343/702; 343/787

(58) Field of Classification Search ..... 343/702, 343/700 MS, 787, 872
See application file for complete search history.

(56) References Cited

U.S. PATENT DOCUMENTS 5,870,065 A * 2/1999 Kanba et al. ..... 343/895
7,333,063 B2 * 2/2008 Yano et al. ..... 343/702
2007/0052600 A1 * 3/2007 Kamitani et al. ..... 343/702
2007/0080866 A1 * 4/2007 Hayakawa et al. .... 343/700 MS
2007/0229373 A1 * 10/2007 Mashima et al. ..... 343/702

FOREIGN PATENT DOCUMENTS

JP 2002-264255 A 9/2002

OTHER PUBLICATIONS

Y. Kawano et al; "A Study on Miniaturization of Planer Inverted F Antenna Utilizing Magneto-Dielectric Material (3)"; B-1-25, 2004; Electronic Information Communication Society Communication Society Convention.

* cited by examiner

*Primary Examiner*—HoangAnh T Le
(74) *Attorney, Agent, or Firm*—Frishauf, Holtz, Goodman & Chick, P.C.

(57) ABSTRACT

An antenna includes an antenna element, and a first magnetic body which is arranged at least a part of the antenna element and has positive magnetostrictive characteristics.

3 Claims, 2 Drawing Sheets

ANTENNA AND RADIO TERMINAL HAVING ANTENNA THEREOF

BACKGROUND OF THE INVENTION

1. Field of the Invention

The present invention relates to an antenna and a radio terminal having the antenna thereof.

2. Description of the Related Art

A radio terminal such as a portable telephone set and a portable information terminal have miniaturized. With the miniaturization of the radio terminal, a radio terminal having a folded-type case or the like has been proposed and put into practice.

To prevent a reduction in sensitivity of the antenna caused by the miniaturization, an approach to arrange a small piece of a magnetic body near by a case-side power-feeding unit of a planar reverse-F antenna and lower a resonant frequency has been proposed (refer to Kawano et al. "A Study on Miniaturization of Planer Inverted F Antenna utilizing Magneto-Dielectric Material (3)", B-1-25, 2004, Electronic Information Communication Society Communication Society Convention). Thereby, an antenna length can be apparently long, so that the proposed approach contributes to the miniaturization of the antenna. As for other approach using the magnetic material, a configuration in which an unnecessary current is efficiently restricted is proposed (refer to Jpn. Pat. Appln. KOKAI Publication No. 2002-264255).

In the aforementioned configuration, it is presumed that the antenna is only a planar shape (or bar shape). Therefore, when the antenna is mounted at a curved part such as a corner part of the case of the radio terminal, or when it is mounted at a movable part of the folded-type radio terminal, because a property of the antenna changes, there is the fear of property deterioration that the resonant frequency becomes higher than a desired resonant frequency. Especially, in the case of a folded-type, the antenna is bent. Accordingly, there is a problem that the antenna length becomes apparently short, because bent antennas are capacity-coupled with each other. The same problem occurs when the antenna is mounted at the curved part of the case.

As described above, when mounting the antenna at the curved part of the case of the radio terminal, there is a problem that the folding of the antenna results in deterioration of a property, for instance, that the resonant frequency becomes higher than desired one caused by the folding the antenna. The deterioration of the property mainly results from the coupling among antenna elements, and it is expected to reduce change in antenna characteristics caused by such curvature of the antenna.

BRIEF SUMMARY OF THE INVENTION

The present invention provides an antenna having small change in property thereof resulting from curvature of the antenna and a radio terminal having the antenna thereof.

An antenna according to one aspect of the invention includes: an antenna element; and at least one of a first magnetic body having positive magnetostrictive characteristics and a second magnetic body having negative magnetostrictive characteristics which are arranged at least a part of the antenna element. Then, when the antenna is mounted along the curved part or the folded part by bending the antenna, the antenna is mounted such that the compression stress is applied to the first magnetic body and the tensile stress is applied to the second magnetic body.

In terms of the antenna according to the present invention, a magnetic body having positive magnetostrictive characteristics increases magnetic permeability when a positive stress is applied to the magnetic body. A magnetic body having negative magnetostrictive characteristics increases magnetic permeability when a negative stress is applied to the magnetic body. BY utilizing the increase in the magnetic permeability, even if the antenna is bent and the antenna length is appeared to be short in equivalence, the appearance is cancelled and the change in property due to the curvature of the antenna becomes small.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be set forth with reference to the drawings.

Figure 1A:
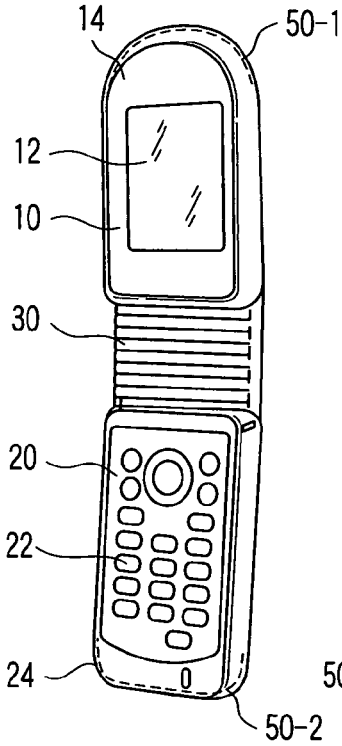
FIG. 1A to FIG. 1D are exemplary views depicting one example of a radio terminal to which an antenna of the present invention is applied.
Figure 1B:
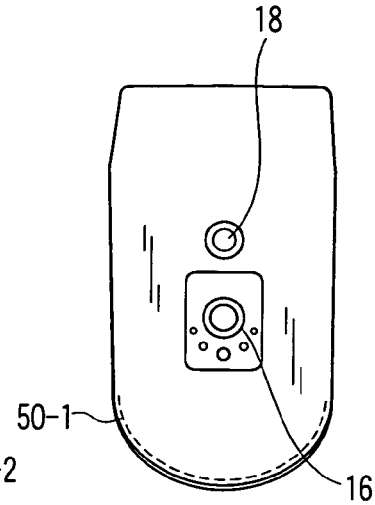
Figure 1C:
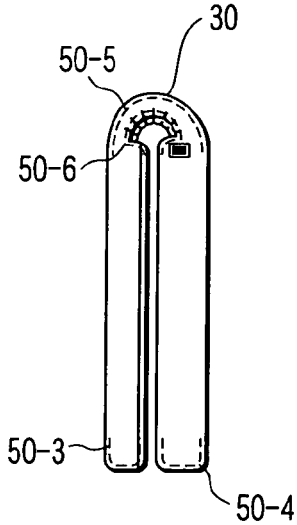
Figure 1D:
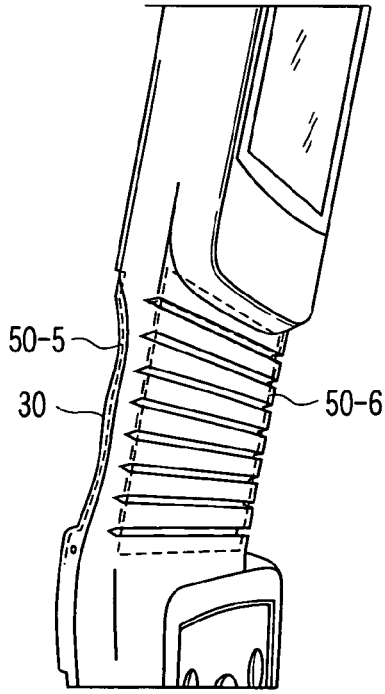

FIG. 1A to FIG. 1D are views illustrating one example of a radio terminal to which an antenna of the present invention is applied. In FIG. 1A to FIG. 1D, the radio terminal is configured to be foldable. FIG. 1A is a view in which the radio terminal is opened. FIG. 1B is a front view when the radio terminal is folded. FIG. 1C is a side view when the radio terminal is folded. FIG. 1D is a perspective view when the radio terminal is opened.

In FIG. 1A to FIG. 1D, the radio terminal has a first case 10, a second case 20 and a folded part 30 supporting the first and second cases 10 and 20 to be foldable.

A liquid crystal display (LCD) 12 is provided on the front surface of the first case 10. A lens unit 16 and a flash 18 for a camera built in the radio terminal are provided on the rear surface of the first case 10. The second case 20 houses a main printed circuit board (not shown), together with a key input device 22, etc. The folded part 30 supports the first and second cases 10 and 20 in fordable manners so that the LCD 12 and key input device 22 folded on internal sides, for instance, by means of a bellows configuration. A speaker (not shown) is disposed near by a curved part at an upper part of the first case 10, a microphone (not shown) is arranged near by a lower part of the second case 20, and then, a communication becomes possible.

Reference symbols 50-1 to 50-6 designated at parts of broken-out sections show parts at which the antenna according to an embodiment of the present invention is mounted. As shown in FIG. 1A to FIG. 1D, the antenna according to the present invention is basically mounted along with the case of the radio terminal. The antenna does not need to be mounted only at the parts 50-1 to 50-6 designated with dashed lines, the parts 50-1 to 50-6 designated with the dashed-lines may be parts of the antenna. In such case, the antenna mounted at the parts 50-1 to 50-6 indicated with the dashed lines to be configured may have at least configuration mentioned below.

Figures 2A, 2B:
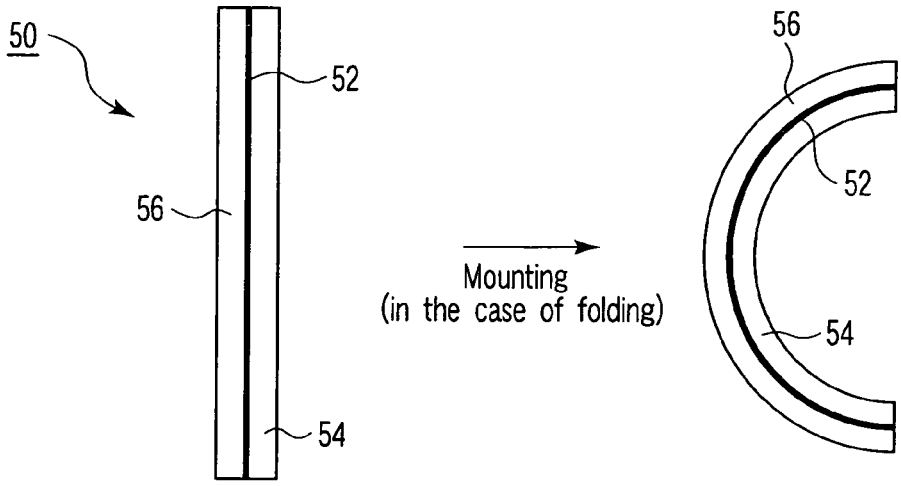
FIG. 2A and FIG. 2B are exemplary views depicting a configuration of an antenna according to an embodiment of the present invention.

FIG. 2A and FIG. 2B are views illustrating a configuration of the antenna according to an embodiment of the present invention. As shown in FIG. 2A and FIG. 2B, an antenna 50 regarding the present embodiment has a first magnetic body 54 having positive magnetostrictive characteristics and a second magnetic body 56 having negative magnetostrictive characteristics, and the first magnetic body 54 and the second magnetic body 56 sandwich an antenna element 52. Since the first magnetic body 54 has the positive magnetostrictive characteristics, it has a property that magnetic permeability increases by applying a compression stress, and that magnetic permeability decreases by applying a tensile stress. Since the second magnetic body 56 has the negative magnetostrictive characteristics, it has a property that magnetic permeability decreases by applying a compression stress, and that magnetic permeability increases by applying a tensile stress, in contrast to the first magnetic body 54. Accordingly, by utilizing the change (increase) of the magnetic permeability of the magnetic body in the case of folding the antenna, the property change resulting from the curvature of the antenna element 52 are reduced.

More specifically, when the antenna 50 having the configuration shown in FIG. 2A is bent as shown in FIG. 2B, the compression stress is applied to the first magnetic body 54 and the tensile stress is applied to the second magnetic body 56. Thereby, both magnetic permeability of the first and second magnetic bodies 54 and 56 are increased. Therefore, since a leakage of fluxes from the antenna element 52 is reduced, the capacity coupling, etc., among the antenna elements 52 are prevented. Therefore, the property change in the case of bending the antenna element 52 can be reduced. In the embodiment, it is necessary to arrange the magnetic body having the positive magnetostrictive characteristics on a surface to which the compression stress is applied, and the magnetic body having the magnetostrictive characteristics on a surface to which the tensile stress is applied.

Figure 3:
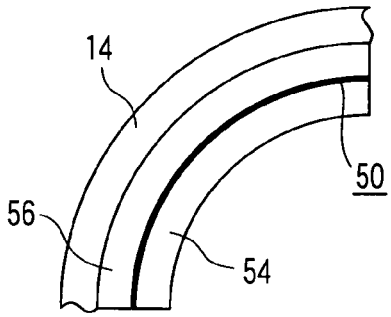
FIG. 3 is an exemplary view depicting an example in which the antenna according to the present invention is mounted inside a curved part of a case.
Figure 4:
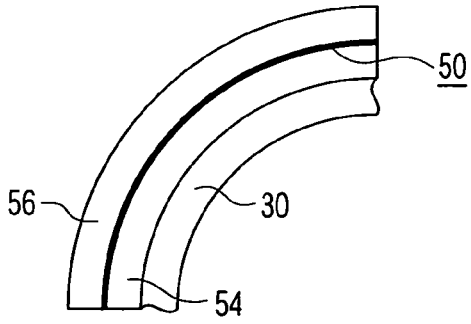
FIG. 4 is an exemplary view depicting an example in which the antenna according to the present invention is mounted outside the curved part of the case.

Specific configuration examples will be illustrated in FIG. 3 and FIG. 4. FIG. 3 and FIG. 4 are views showing examples in which the antennas regarding the present embodiments inside and outside the curved parts of the cases, respectively. FIG. 3 and FIG. 4 are, for example, cross-sectional views when each antenna 50 is mounted at the curved part 14 or the folded part 30 in FIG. 1A, respectively. The antenna 50 is applicable at various positions, such as the curved part 24 and other corner part of the second case 20 in addition to the curved part 14. More specifically, the antenna having the configuration regarding FIG. 3 is applicable to the antenna mounted at the parts indicated with the symbols 50-1 to 50-5 in FIG. 1. The antenna having the configuration relating to FIG. 4 is applicable to the antenna mounted at the part indicated with the symbol 50-6 shown in FIG. 1. Like this, the antenna according to the embodiment is configured so as not to be deteriorated in its performance, for instance, even when it is mounted at the fixed curved parts 14, 24 or the folded part 30 that is the movable part in the radio terminal of FIG. 1. In the following description, the curved parts 14 and 24 are referred to as "curved part", and the case in which the antenna 50 is disposed at the curved part 14 will be described.

FIG. 3 shows the case in which the antenna 50 is disposed inside the curved part 14. As shown in FIG. 3, when disposing the antenna 50 inside the curved part 14 of the first case 10 (of course, the second case 20 is useful and hereinafter, referred to as only "case"), the antenna 50 is arranged in the order of the second magnetic body 56 with the negative magnetostrictive characteristics, the antenna element 52, and the first magnetic body 54 with the positive magnetostrictive characteristics from the case 10 side. Thereby, the magnetic permeability of each magnetic body increasing, the problem in the case of folding of the antenna element 52 can be solved.

FIG. 4 shows the case where the antenna 50 is arranged inside the folded part 30 (part indicating with reference symbol 50-6). As shown in FIG. 4, when the antenna 50 is disposed inside the folded part 30, the antenna 50 is arranged in the order of the magnetic body 54 with the positive magnetostrictive characteristics, the antenna element 52, and the second magnetic body 56 with the negative magnetostrictive characteristics from the part inside the folded part 30. Thereby, like the case of FIG. 3, the magnetic permeability of each magnetic body increasing, the radio terminal can solve the problem when the antenna 52 is folded. In the foregoing embodiment, having shown the example in which the antenna element is mounted at the curved part or the folded part of the case, even when the antenna according to the present embodiment is folded and mounted, for example, at inner components such as an LCD holder, the same advantage can be obtained.

In the configurations in FIG. 3 and FIG. 4, the mounting of the antenna 50 onto the case 10 may be performed, for instance, by bonding. Further, with a attaching part such as a pawl for fixing provided for the case 10, with the antenna 50 engaged into the attaching part, and with the antenna 50 is fixed by other method, the antenna 50 is mounted on the case 10. Other than this, any method may be useful for the mounting as long as it is possible for the antenna 50 to be mounted on the radio terminal.

In the aforementioned embodiment, the magnetic bodies with the positive and negative magnetostrictive characteristics are arranged on both sides of the antenna element 52, respectively. It is unnecessary to cover the whole surface of the antenna element 52 by the magnetic bodies, and it is enough to cover only a part of a conductor functioning as the antenna. It is also acceptable to cover only the part functioning as the antenna without covering the whole parts thereof.

It is not always necessary for the magnetic bodies to be disposed both sides of the antenna element 52, at least the magnetic body having the positive magnetostrictive characteristics may be disposed at the antenna element 52.

In the above-mentioned embodiment, though the configuration of the antenna element 52 is not specifically described, the antenna element 52 may be any shape as long as it is foldable, for instance, a variety of shapes, such as a rod shape, loop shape, meander shape, helical shape are applicable to the antenna element 52.

According to the present embodiment, the property change caused by the curvature of the antenna can be reduced.

Additional advantages and modifications will readily occur to those skilled in the art. Therefore, the present invention in its broader aspects is not limited to the specific details, representative devices, and illustrated examples shown and described herein. Accordingly, various modifications may be made without departing from the spirit or scope of the general inventive concept as defined by the appended claims and their equivalents.

What is claimed is:

1. A radio equipment comprising:

(i) a case which has a curved part; and (ii) an antenna, which comprises:

an antenna element; and a magnetic body which is arranged at at least a part of the antenna element, and which has positive magnetostrictive characteristics such that magnetic permeability of the magnetic body increases when compression stress is applied to the magnetic body;

wherein the antenna is mounted along the curved part such that the antenna is curved and compression stress is applied to the magnetic body.

2. A radio equipment comprising:

(i) a case which has a curved part; and (ii) an antenna, which comprises:

an antenna element;

a first magnetic body which is arranged at at least a part of the antenna element, and which has positive magnetostrictive characteristics such that magnetic permeability of the first magnetic body increases when compression stress is applied to the first magnetic body; and a second magnetic body having negative magnetostrictive characteristics such that magnetic permeability of the second magnetic body increases when tensile stress is applied to the second magnetic body, wherein the first magnetic body and the second magnetic body are arranged so as to sandwich at least a part of the antenna element, wherein the antenna is mounted along the curved part such that the antenna is curved and compression stress is applied to the first magnetic body and tensile stress is applied to the second magnetic body.

3. A radio equipment comprising:

(i) a case which has a curved part; and (ii) an antenna, which comprises:

an antenna element; and a magnetic body which is arranged at at least a part of the antenna element, and which has negative magnetostrictive characteristics such that magnetic permeability of the magnetic body increases when tensile stress is applied to the magnetic body, wherein the antenna is mounted along the curved part such that the antenna is curved and tensile stress is applied to the magnetic body.

* * * * *